US011058190B2

(12) United States Patent
Nam

(10) Patent No.: US 11,058,190 B2
(45) Date of Patent: Jul. 13, 2021

(54) JEWELRY SYSTEM

(71) Applicant: Gina Nam, New York, NY (US)

(72) Inventor: Gina Woo Nam, New York, NY (US)

( * ) Notice: Subject to any disclaimer, the term of this patent is extended or adjusted under 35 U.S.C. 154(b) by 94 days.

(21) Appl. No.: 16/395,310

(22) Filed: Apr. 26, 2019

(65) Prior Publication Data

US 2020/0337422 A1 Oct. 29, 2020

(51) Int. Cl.

| | |
|---|---|
| ***A44C 5/00*** | (2006.01) |
| ***A44C 11/00*** | (2006.01) |
| ***A44C 15/00*** | (2006.01) |
| ***A44C 5/20*** | (2006.01) |
| ***A44C 5/10*** | (2006.01) |

(52) U.S. Cl.

CPC ..... *A44C 5/2014* (2013.01); *A44C 5/10* (2013.01); *A44C 15/005* (2013.01)

(58) Field of Classification Search

CPC ..... A44C 5/00; A44C 5/0007; A44C 5/02; A44C 5/10; A44C 5/102; A44C 5/105; A44C 5/107; A44C 11/00; A44C 13/00; A44C 15/0045; A44C 15/005; A44C 15/0055; A44C 5/12; A44C 5/0015; A44C 5/0023; A44C 5/003; A44C 5/0038; A44C 5/0046; A44C 5/0053; A44C 5/0061; A44C 5/0069; A44C 5/0076; A44C 5/0084; A44C 5/0092; A44C 15/00; A44C 15/001; A44C 15/0015; A44C 15/002; A44C 15/0025; A44C 15/003; A44C 15/004; A44C 25/00; A44C 25/001

USPC .... D11/3, 6, 8, 9, 10, 11, 12, 13, 14; 63/21, 63/40, 41

See application file for complete search history.

(56) References Cited

FOREIGN PATENT DOCUMENTS

CA 2911898 A1 * 5/2017 ..... A44C 11/00

* cited by examiner

*Primary Examiner* — Jack W Lavinder

(57) ABSTRACT

The jewelry system of the present invention is used for easily layering jewelry by connecting strands of similar types of jewelry, such as necklace strands, into a layered jewelry piece (e.g. multi-strand necklace), and which prevents tangling and provides a distinctive presentation of each layer. The present invention allows for variety in the combining and re-arranging of individual strands in any desired order, by the use of end couplers on the ends of each strand and one or more connector pairs disposed on one or more of strands. This allows for the creation of customized layered jewelry pieces that can be adjusted to suit a variety of styles. The design of the present invention allows for the use of singular strands to form into a layered jewelry piece that is distinctively presented in a symmetrical, cascading arrangement, which moves uniformly as one piece with the weight of gravity, virtually eliminating the risk of tangling. An additional purpose of this system is to have more versatility for the user's jewelry and increase the convenience of wearing fully constructed, customizable, layered jewelry pieces which can be put on and removed as one piece.

20 Claims, 10 Drawing Sheets

JEWELRY SYSTEM

CROSS REFERENCE TO RELATED APPLICATIONS

The present application is related to an application of the Applicant, U.S. Non-Provisional patent application Ser. No. 15/919,758 filed Mar. 13, 2018, and entitled "NECKLACE".

BACKGROUND OF THE INVENTION

1. Field of the Invention

This invention is relevant to layering jewelry pieces. Layered jewelry pertains to jewelry, where all the strands are the same type (for example, all of the strands are necklace strands), and a plurality of which are worn at the same time in a layered or tiered fashion.

2. Description of Related Art

The present invention can be used for many jewelry applications and, in particular, necklaces. Wearing tiered or layered necklaces is a popular and long-standing trend. Trends for wearing layered necklaces have, for the most part, followed the style of necklines or outfits by occasion. As necklines were lowered, wearing multiple necklaces was desirable. Layering of individual necklaces allows for more variety, as the consumer can create their own unique layered set and ultimately make more use of their jewelry overall. Necklaces are fundamentally constructed with clasp(s), a strand, and they may have an extension. The measurement from one end of the strand to the other is defined as the "length." The length of a necklace determines how low the necklace will fall from the base of the neck. In layered necklaces or jewelry pieces, the base ("necklace") strand (or the strand that lays closest to the neck, for example) is shorter than or equivalent in length to the other strands to be used in the layered piece (e.g. necklace).

The most common way to wear layered necklaces is to wear individual necklaces at the same time. Some issues arise with this approach. For example, the consumer must make sure that each necklace is a different length. This is important to create the desired spacing that the look requires or, in other words, to prevent necklaces from sitting in a pile. Another issue with this approach is that the strands inevitably intertwine and become tangled. Tangling makes the necklace more prone to breaking and becomes a time-consuming task to put on or remove. Still another issue with this approach is that, because of the weight of the clasp and extension, they unattractively fall to the front.

Another common approach for wearing layered necklaces is the pre-formed multi-strand necklace. In this case, several strands are permanently connected together into a multi-strand necklace that has the appearance of a layered necklace. This approach has the disadvantages of being inflexible since the necklace strands cannot be worn individually or singularly and is expensive.

Another approach for layering necklaces is a type of finding, such as a clasp connector or necklace spacer. For it to be used in a layered necklace, necklaces of different lengths are required for the desired spacing, and it doesn't work for every type of singular necklace. These can also be quite conspicuous when worn with slender or more delicate strands which are not aesthetically pleasant. Some examples of these findings are:

U.S. Pat. No. 5,369,854 (Stephens) discloses a necklace clasp with a two-part holding device designed for wearing multiple necklaces; and U.S. Pat. Nos. 7,980,095 and 8,479,536 (Masterson), disclose a system of multi-connector findings connected with other jewelry types to form customizable styles.

Also, there are other forms of multi-strand jewelry which are customizable but which are not layered jewelry pieces and include examples where one type of strand is used to adorn another type of strand. Some examples of these are:

US publication 2013/0091894 (Brown), a customizable system where one type of strand is used to embellish another type of strand;

In USD810605 (Zachos), an ornamental design for a convertible jewelry set. In this case, a necklace is adorned by a bracelet; and US publication 2004/0200236 (Emberson), shows a building block system for building strands or lanyards with sections having magnets at the ends. None of these are layered jewelry pieces, nor do they teach the present invention.

What is needed is a jewelry system for layering jewelry applications that: also allows individual (e.g. necklace) strands of equivalent length (as well as strands of different lengths) to be removably connected into a layered jewelry piece with consistent spacing between each layer: prevents tangling; and provides an effortless way to remove and put on all at once.

SUMMARY OF THE INVENTION

The present invention is a jewelry system that provides a solution to the issues described above and others not addressed above for necklaces and other jewelry applications, including, but not limited to bracelets, anklets, body chains, belly chains, etc. The invention provides for, in a variety of embodiments: one or more strands, each strand having a end jewelry coupler, such as clasp, at both ends of the strand for removable connection with each other, with other strands or with accessories; and with at least one of these strands having one or more connector pairs, with each connector pair having a jewelry coupler, such as a ring connector, disposed on either side of the strand a similar distance from the end of the strand for removable connection with the end couplers of other strands.

Additional features and/or accessories for the jewelry system of the present invention include a detachable length adjuster or additional couplings for adjusting the length of a strand being used as a base layer in the layered jewelry piece and removable display sections in one or more of the strands.

This invention is a jewelry system that: allows consumers to layer individual strands, such as necklaces, without the issue of tangling; reduces the task of putting on and removing layered necklaces to one convenient step (one clasp); allows for customizing the position of each necklace so that multiple necklaces of the same original length can be worn with space between them; and caters to both right-handed and left-handed consumers.

Objectives:

An objective of this invention is to provide a jewelry system with connector pairs and end connectors or couplers that connect individual strands of jewelry into a layered, multi-strand necklace, and where each strand can be worn on its own.

Another objective of this invention is to provide a jewelry system with connector pairs and end couplers that allow for necklaces of the same length to be worn with desirable spacing in between each necklace.

Another objective of this invention is to provide a jewelry system with connector pairs and end couplers that will allow the user to easily rearrange and adjust the length of each layer that best suits the user's neckline.

Another objective of this invention is to provide a jewelry system with connector pairs and end couplers that prevent necklace strands (e.g. chains) from tangling while worn.

Another objective of this invention is to provide a jewelry system with connector pairs and end couplers that help to eliminate the time-consuming process of putting on or taking off each strand (e.g. necklace), one by one. Once the individual necklaces are assembled into a layered jewelry piece, the entire layered jewelry piece (e.g. necklace) can easily be put on or removed by a single clasp.

Another objective of this invention is to provide a jewelry system with connector pairs and end couplers that prevent necklace strands (e.g. chains) from tangling while worn.

Another objective of this invention is to provide a jewelry system with connector pairs and end couplers that form a perfectly symmetrical layered or tiered jewelry piece design that allows for a balanced distribution of weight while also allowing for desirable spacing between layers.

The invention is described more thoroughly with illustrations herein.

DETAILED DESCRIPTION

While various embodiments of the present invention are discussed in detail below, it should be appreciated that the present invention can be embodied in a wide variety of specific contexts. The specific embodiments discussed herein are merely illustrative of specific ways to make and use the invention and do not limit the scope of the invention.

Figure 1A:
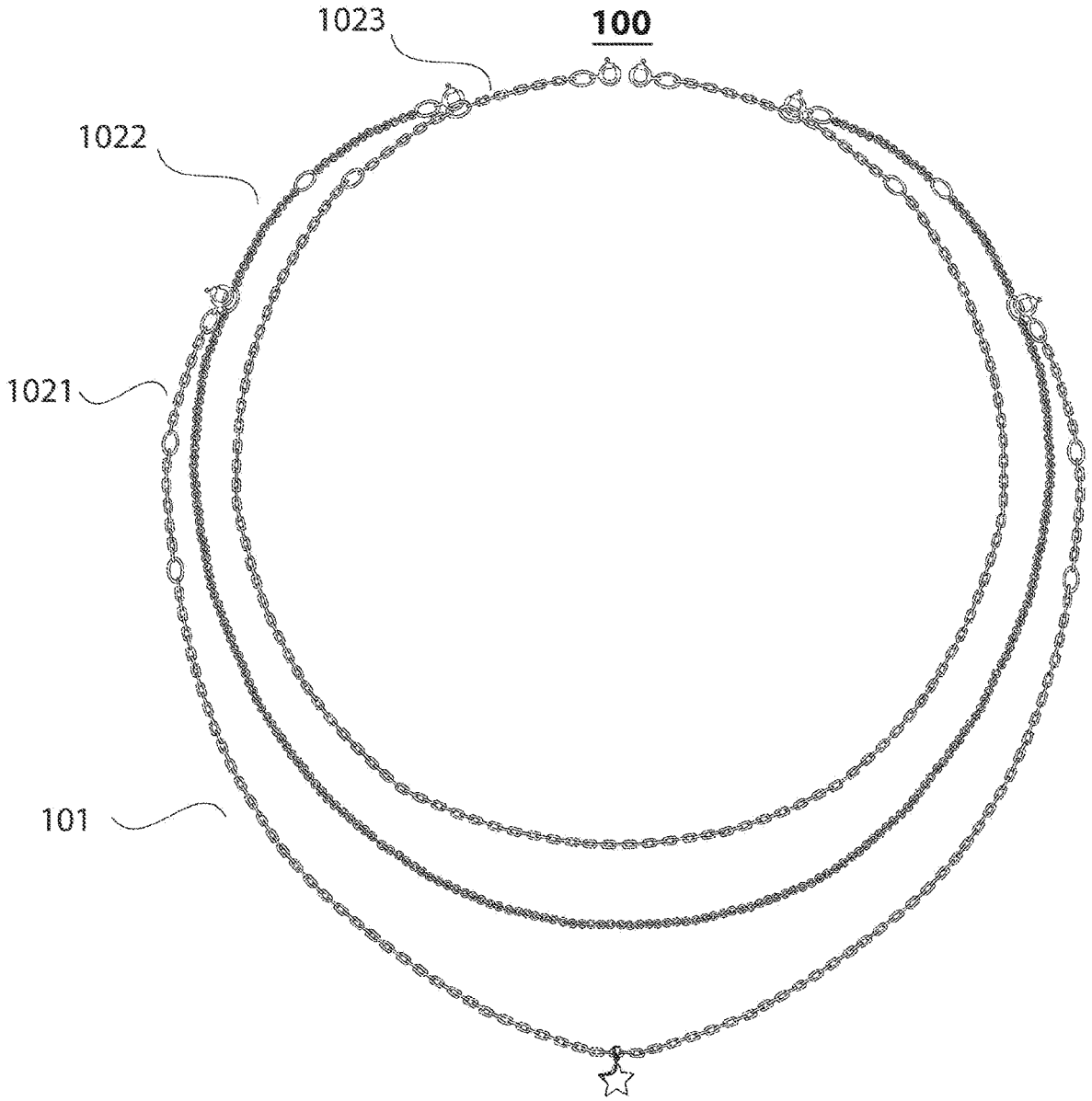
FIG. 1A is a front or top view of a layered jewelry piece employing the present invention and ready for display or wearing.

Referring to FIG. 1A, a front or top view of a layered jewel piece 101 using the jewelry system 100 of the present invention is depicted and is ready for display or wearing. The layered jewelry piece 101 includes three strands 1021, 1022 and 1023. These strands are described in detail below. Strand 1021 is removably connected to strand 1022 and strand 1022 is removably connected to strand 1023. As these strands are connected together, each strand becomes a layer in the layered jewelry piece 101 with strand 1023 serving as a base layer. The ends of strand 1023 then can easily be removably connected together making strand 1023 a base layer for display; namely, for wearing or showing, etc. It will be appreciated and understood that the three strands in FIG. 1A is by way of example and that the layered jewelry piece of the present invention may have fewer or more strands and/or layers.

Figure 1B:
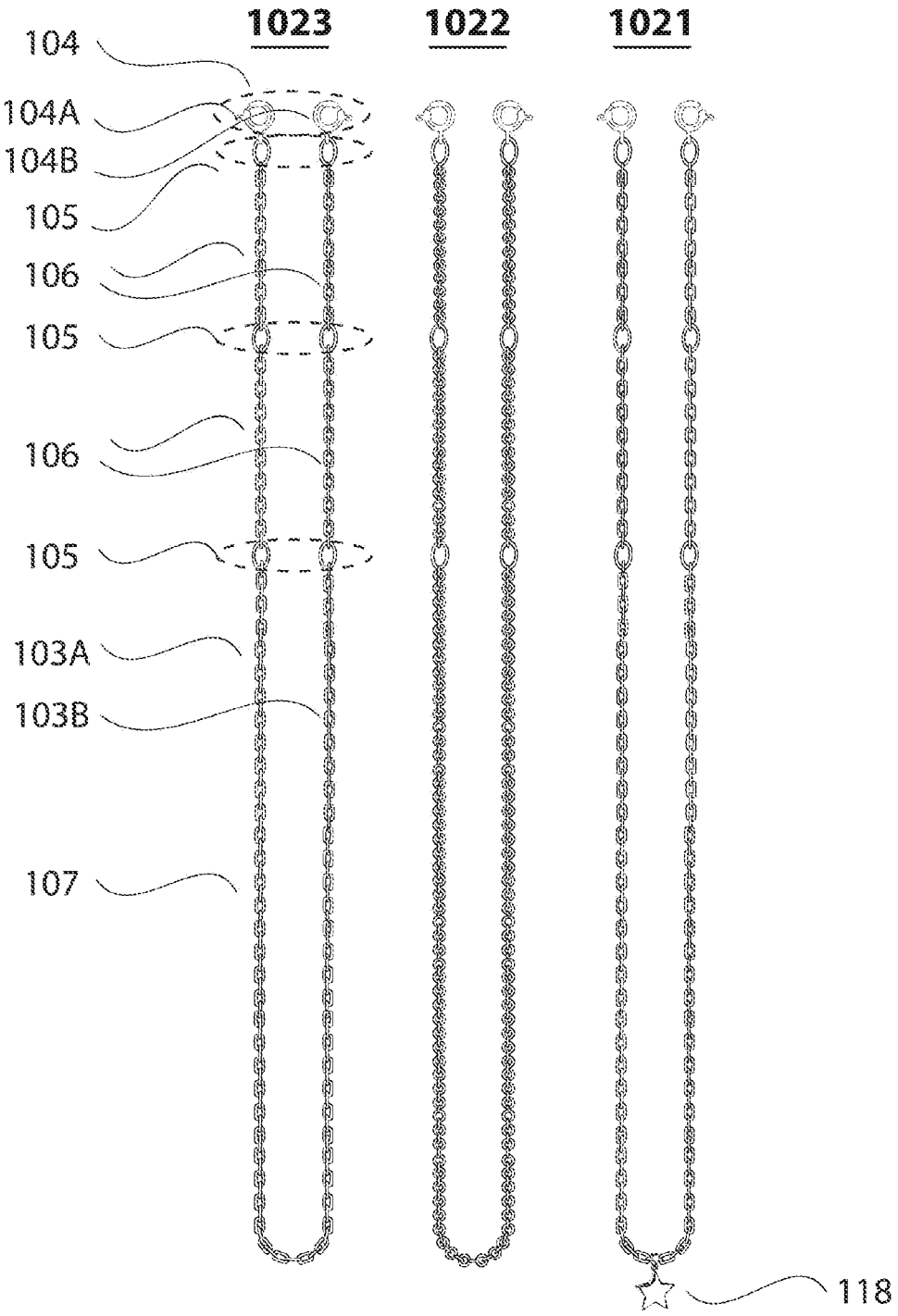
FIG. 1B is a front or top view of the plurality of individual strands used for the layered jewelry piece depicted in FIG. 1A.

Referring now to FIG. 1B, the strands 1021, 1022 and 1023 are depicted in more detail. Strand 1023 has an A side 103A and a B side 103B as shown for strand 1023. An end coupler pair 104 is connected to the ends of strand 1023 and, more specifically, end coupler 104A is connected to the end of A side 103A and the end coupler 104B is connected to the end of B side 103B. It will be appreciated and understood that the end couplers 104A and 104B may be any form of jewelry coupler capable of removable connection to another jewelry coupler and are preferably clasps.

Still referring to FIG. 1B, the strand 1023 also has one or more connector pairs 105 disposed therein or thereon. In FIG. 1B, three connector pairs 105 are depicted, for example. Each connector pair 105 has a connector disposed on the A side 103A of strand 1023 and a connector 105B disposed on the B side 103B of strand 1023. It will be appreciated and understood that any form of jewelry coupler may be used in the connector pairs and that ring connectors are preferable. It will also be appreciated and understood, that, where feasible in the drawings, connector pairs are shown within a circular or oval broken line for convenience of identification.

Strand 1023 also has a plurality of connector pair sections 106 disposed between the connectors of successive connector pairs on the A side 103A and the B side 103B and a display section 107 disposed between the connectors 105A and 105B of the connector pair 105 located furthest from the ends of strand 1023 and which completes the strand 1023. The display section 107 may be decorative and may vary in appearance from strand to strand of the jewelry system of the present invention.

Strand 1023 in FIG. 1B depicts an optional connector pair 105 disposed at the ends of the A and B sides of strand 1023 and to each of which, an end coupler of end coupler pair 104 and a connector pair section 106 is connected. The connectors in this optional connector pair 105 become the ends of strand 1023. Similarly, the connector pairs at the ends of strands 1021 and 1022 are optional and become part of the ends of those strands Although, for an embodiment of the invention as depicted in FIG. 1A, the connectors are ring connectors (or jump rings) which interconnect the connector pair sections 106 and the display section 107, it will be appreciated that other embodiments, within the scope of the present invention, can be used. For example, strand 1023 could be one, continuous strand to which connectors of each pair 105 and/or the end couplers 104A and/or 104B are connected or attached separately.

It will be appreciated and understood that, the description above and below for strand 1023 applies equally to strands 1021 and 1022 in FIG. 1B with the exception that the display section 107 of strand 1021 includes an optional ornament 118.

Still referring to FIG. 1B, strand 1023, which becomes the base layer 1023 of layered jewelry piece 101 in FIG. 1A, is depicted with 2 connector pairs 105 in addition to the optional connector pair at the ends of the strand 1023. As noted above, more or fewer connector pairs 105 can be utilized. Each connector of a connector pair 105 disposed on the A side 103A of strand 1023 is located a similar distance from the end of the A side 103 as the distance from the end of the B side 103B of strand 1023 to connector in the pair disposed on the B side 103 B of strand 1023. It is this similar spacing or distance to connectors in each connector pair (i.e. the connector-to-end spacing), that generates a distinctive and balanced appearance or presentation of each strand (e.g. 1021. 1022 and 1023) of the layered piece 101 when it is displayed by insuring that the ends of each strand or layer start at the same height while the spacing between different connector pairs create distinctive spacing between the strands or layers. When strands are connected into a layered jewelry piece using the present invention, such as, layered jewelry piece 101 depicted in FIG. 1A, the individual strands are virtually prevented from tangling because of the cascading arrangement of the strands (e.g. 1021, 1022 and 1023) in the layered jewelry piece 101 (e.g. 1021, 1022 and 1023). The wearer is building a layered jewelry piece out of multiple strands that are connected to each other. When the wearer moves, each layer does not move in its own direction; the symmetry and cascade design of the layered piece remains fixed as it moves uniformly. Therefore, the weight of each individual strand that is added as a layer accumulates to the weight of the layered piece as a whole. The cascading arrangement results in weight that pulls in the same direction, at the same time, with the weight of gravity. This design virtually eliminates the risk of tangling.

Referring back to FIG. 1A, the end couplers (e.g. 104A and 104B as depicted in FIG. 1B for strand 1023) of layer 1022 are removably connected to the first connector pair 105 (in FIG. 1B) on base layer 1023 removed from the ends of that strand (i.e. base layer 1023). End couplers (e.g. 104A and 104B as shown in FIG. 1B) of layer 1021 are removably connected to the second connector pair 105 on layer 1022 removed from the ends of that strand (i.e. layer 1022). This changes the presentation of the layered jewelry piece 101 by increasing the spacing between layers 1022 and 1021 as shown in FIG. 1A. Thus the user is presented with numerous spacing options for display of the layered jewelry piece (e.g. 101) of jewelry system 100. It will also be appreciated that, for example, and although not preferable, only the connector pairs of the base layer (e.g. 1023) may be used to removably connect with the end couplers 104 of additional layers (e.g. 1022 and 1021). Similarly, a combination of connector pairs from different strands including the base strand (e.g. 1023) may be used to build or assemble a layered jewelry piece using the jewelry system 100 of the present invention.

Different display sections 107 may be used for each strand in the jewelry system 100 further increasing the user's options for layered jewelry pieces. Additionally, the optional connector pair at the ends of the A and B sides, 103A and 103B respectively, (e.g. of strand or layer 1023) to connect an additional layer to the layered jewelry piece 101. Moreover, the user could use existing or other strands as layers that do not have connector pairs, with the jewelry system 100 of the present invention as long as a base strand or layer with connector pairs 105 (e.g. 1023) is used. All of the above further increases the presentation or display options and the flexibility of the jewelry system 100.

Still referring to FIG. 1B, the strands (1021, 1022 and 1023) depicted are all a similar or equivalent length. It will be understood that different length strands can be used with the present invention. Preferably, the strands are all of one or two standard strand lengths.

The strands 1021, 1022 and 1023: can be made of any jewelry material such as gold, silver, platinum, etc.; can be solid, chain or any other form; may have separate sections or be continuous strand; and may be plain, decorative or mixed styles As noted above, any form of jewelry coupler may be used for each the end couplers 104A and 104B of any end coupler pair 104 and the connector pairs 105. For the end couplers 104, it is preferable that a clasp, which may be removably connected to another jewelry coupler, is used. Preferably, the clasp is made of the same material as the strand (e.g. 1023). Clasps include, but are not limited to, spring ring clasps, toggle clasps, hook and eye clasps, lobster clasps, magnetic clasps, S-hook clasps, push clasps and push-release clasps. In FIG. 1B, spring ring clasps are depicted for the end coupler pairs 104.

The connector pairs 105 may be made of any suitable material but are, preferably, of the same material, gold, etc. as the strand (e.g. 1023). Although any form of jewelry coupler may be used for any or all the connector pairs 105, a ring connector or jump ring, to which a clasp can be removably connected, is preferable. The ring connectors may be of any shape such as, for example, round, oval, triangular or square. In FIG. 1B the ring connectors are round. The size of the inner cavity of the ring connector must be large enough to easily accommodate the ends of two separate connector pair sections 106 of the strand being interconnected and a clasp, such an end coupler such as 104A or 104B.

Figure 2A:
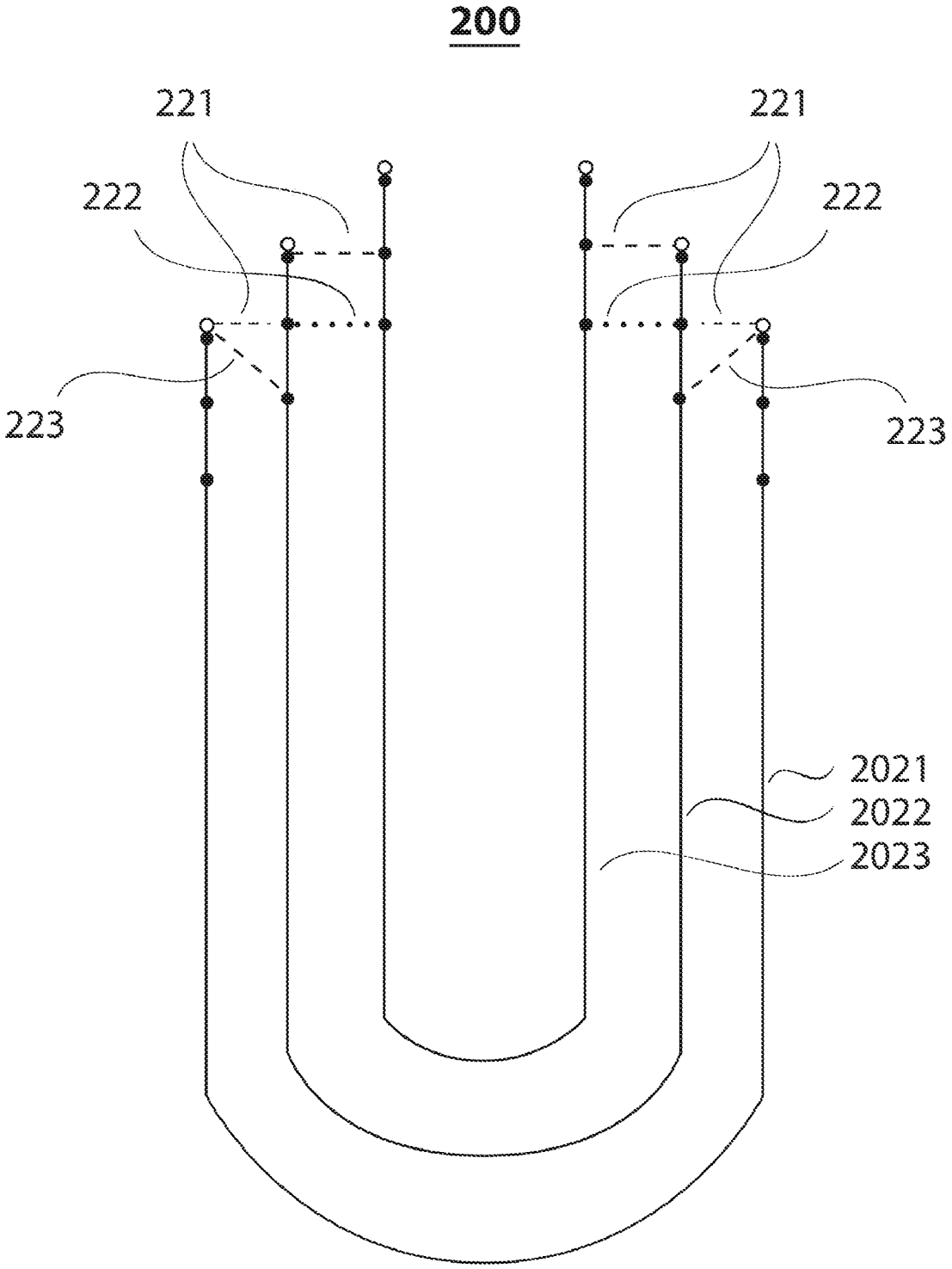
FIG. 2A is a front view of a schematic diagram of the jewelry system of the present invention.

Referring now to FIG. 2A, a schematic diagram of the jewelry system 200 in layered format of the present invention, with limited reference information is presented. Three strands 2021, 2022 and 2023, which can be removably connected together to form a layered jewelry piece, are shown. In FIG. 2A, on each strand (2021, 2022 and 2023) the connector pairs are denoted schematically as solid circles and each strand (2021, 2022 and 2023) has the optional connector pair as the ends of the strand. Strand 2023 has been selected to be the base strand or layer. For the purpose of displaying the jewelry system 200 in layered schematic form, strand or layer 2022 is depicted as partially encompassing base strand or base layer 2023. Similarly, strand or layer 2021 is depicted as partially encompassing strand or layer 2022. In FIG. 2A the connection path of end couplers of strand or layer 2022 to a connector pair on the base strand or layer 2023 is depicted as horizontal broken lines 221. Similarly, the connection path of end couplers of strand or layer 2021 to a connector pair on the strand or layer 2022 is depicted as horizontal broken lines 221. The diagonal broken lines 223 schematically depict the connection path of the end couplers of strand or layer 2021 to a connector pair on the strand or layer 2022 as used in the layered jewelry piece 101 shown in FIG. 1A and which would result in greater display spacing between layers 2021 and 2022 than depicted in FIGS. 2A and 2B. The dotted horizontal lines 222 denote the connection path of end couplers of strand or layer 2021 to a connector pair on the base strand or layer 2023 should that option be desired if, for example, strand or layer 2022 did not have connector pairs.

Figure 2B:
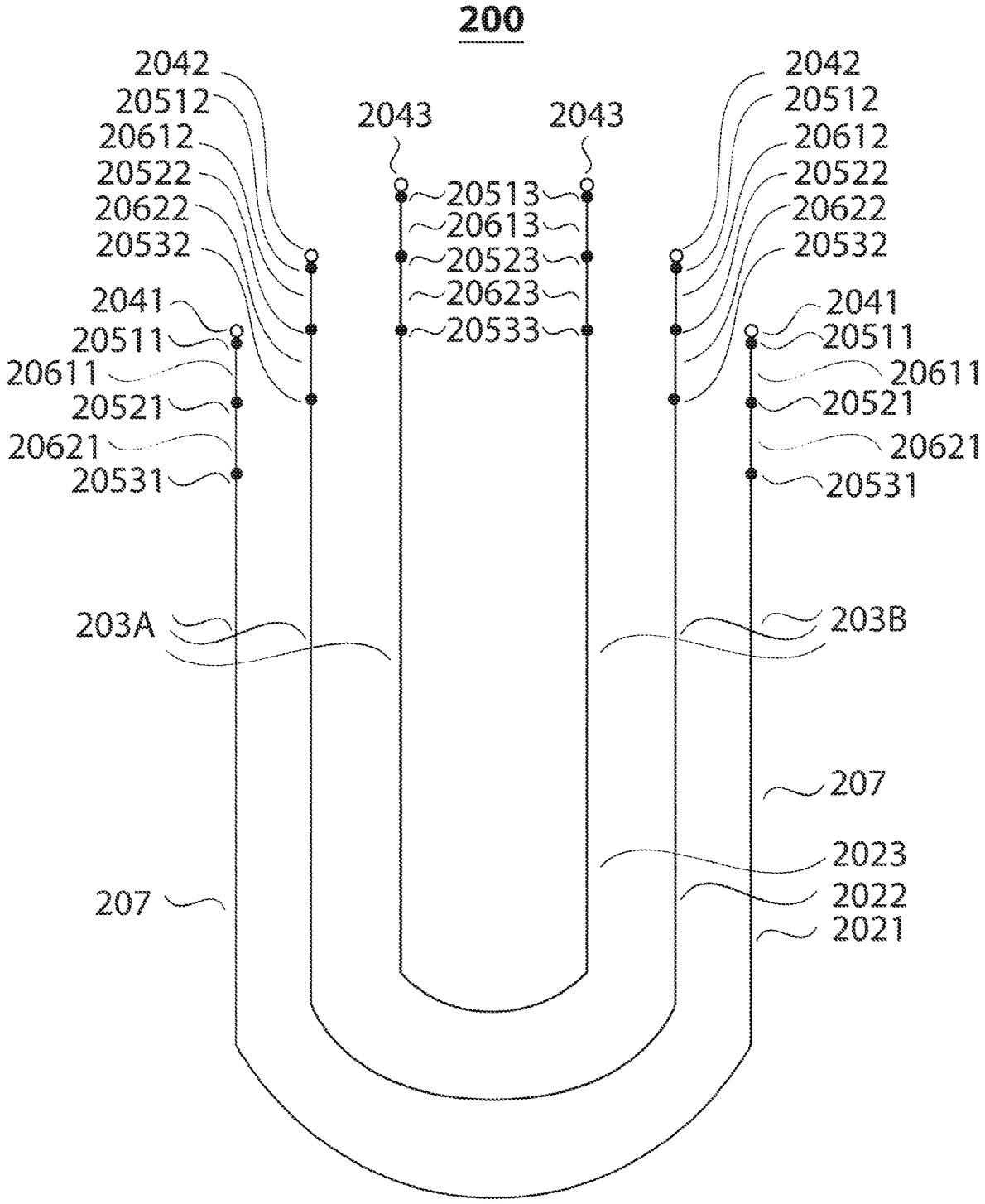
FIG. 2B is the schematic diagram of FIG. 2A with more detail information.

Referring now to FIG. 2B, each strand or layer 2021, 2022 and 2023 has an optional end connector pair, 20511, 20512 and 20513 connected to the ends of the A and B side, 203A and 203B of each strand or layer 2021, 2022 and 2023, respectively. End coupler pairs 2041, 2042 and 2043 are connected to the optional end connector pairs 20511, 20512 and 20513, respectively. With this particular embodiment, the optional end connector pairs 20511, 20512 and 20513 become the ends of each strand.

As depicted in FIGS. 2A and 2B, each strand (i.e. 2021, 2022 and 2023) has two additional connector pairs connected therein or thereon. More specifically, connector pairs 20521, 20522 and 20523 are connected to strands 2021, 2022 and 2023, respectively; and connector pairs 20531, 20532 and 20533 are connected to strands 2021, 2022 and 2023, respectively, and furthest from the ends of A and B sides 203A and 203B of each such strand. It will be appreciated and understood that, in jewelry system 200 of the present invention, all, some or none of the additional strands (e.g. 2021, 2022) may have connector pairs and that only the base strand or layer must have one or more connector pairs (e.g. 20513, 20523 and 20533).

Still referring to FIG. 2B, the inter-pair spacing or spacing between connector pairs is also denoted for each strand 2021, 2022, and 2023. More specifically, for strand 2021, two inter-pair spacings 20611 and 20621 in both side A 203A and in side B 203B and a display section spacing 207 are depicted; for strand 2022, two inter-pair spacings 20612 and 20622 in both side A 203A and side B 203B and a display section spacing 207 are depicted; and for strand 2021, two inter-pair spacings 20613 and 20623 in both side A 203A and in side B 203B and a display section spacing 207 are depicted. As will be explained below, the spacing or length of each pair of inter-pair spacings (e.g. 20611 on side A and on Side B of strand 2021) are similar (the same or approximately the same).

In the jewelry system 200 of the present invention, the distance or spacing for both connectors, of each and every connector pair, from the respective ends of the strand on which such connector pair is disposed is similar (i.e. the same or approximately the same). This distance or spacing is referred to hereafter as the connector-to-end spacing. For example, the connector-to-end spacing for connector 20523 (of the connector pair) disposed on or in side A 203A of strand 2023 is similar to the connector-to-end spacing for the other connector 20523 (of such connector pair) disposed on or in side B (203B) of strand 2023. As an another example, the connector-to-end spacing for connector 20531 (of the connector pair) disposed on or in side A 203A of strand 2021 is similar to the connector-to-end spacing for the other connector 20531 (of such connector pair) disposed on or in side B (203B) of strand 2021.

As noted above, the inter-pair spacing or the spacing between the connectors of successive connector pairs on a strand (i.e. 20611, 20612, 20612, 20622, 20613 and 20623) is similar (i.e. the same or approximately the same) for each pair (e.g. both 20611 spacings are similar, etc.) The inter-pair spacing or distance is determined by the connector-to-end spacing on the strand. For example, the inter-pair spacing 20623 between connector 20523 (of a connector pair) connected on or in side A 203A of strand 2023 and connector 20533 (of the next connector pair) connected on or in side A 203A of strand 2023 is similar to the inter-pair spacing 20623 for connector 20523 (of such connector pair) connected on or in side B 203B of strand 2023 spacing and connector 20533 (of the such next connector pair) connected on or in side B 203B of strand 2023. As another example, the inter-pair spacing 20612 between connector 20512 (of a connector pair) connected on or in side A 203A of strand 2022 and connector 20522 (of the next connector pair) connected on or in side A 203A of strand 2022 is similar to the inter-pair spacing 20612 for connector 20512 (of such connector pair) connected on or in side B 203B of strand 2022 spacing and connector 20522 (of the such next connector pair) connected on or in side B 203B of strand 2022.

The connector-to-end spacings and the inter-pair spacings are similar or equivalent in each strand. Although it is preferable to have equivalent connector-to-end spacing and inter-pair spacing for each strand, it will be appreciated and understood that these may be vary from strand to strand. Moreover, these spacings may be equivalent, different or a combination thereof within a strand. It will be appreciated and understood then, with respect to layered jewelry pieces assembled or built from the jewelry system 200 of the present invention, that the connector-to-end spacing provides for a balanced and evenly weighted distribution of each layer and that inter-pair spacing, together with the length of the strands, provides a symmetry and a cascade design of the layers (e.g. 2021, 2022 and 2023) to the layered jewelry piece which is distinctively presented while the piece is being displayed (i.e. shown or worn) and which moves uniformly and prevents tangling of the strands.

If, in FIG. 2B, separate sections of strand are used to interconnect between connector pairs, (such as connector pair sections 106 for strand or layer 1023 in FIG. 1B), for example), then, the length of the each connector pair section on either side of a strand will be the inter-pair spacing (e.g. 20613 and 20623 of strand 2023).

The length or spacing of display section 107 of any strand (e.g. 1023) will be the display section spacing 207 (e.g. for strand 2023). The display section spacing 207 of any strand (e.g. for strand 2023) is determined by the difference between the desired length of the entire strand and the connector-to-end spacing of the connector pair furthest from the ends of such strand (e.g. For example, if the connector-to-end spacing of connector pair 20533 on strand or layer 2023 is two inches and the desired strand length of strand 2023 is 15 inches, then the length of the display section 207 for strand or layer 2023 is 11 inches (15 inches minus 2 inches for the connector-to-end spacing on the side A 203A of strand 2023 and minus 2 inches for the inter-pair spacing on the side B 203B of strand 2023).

Figure 3A:
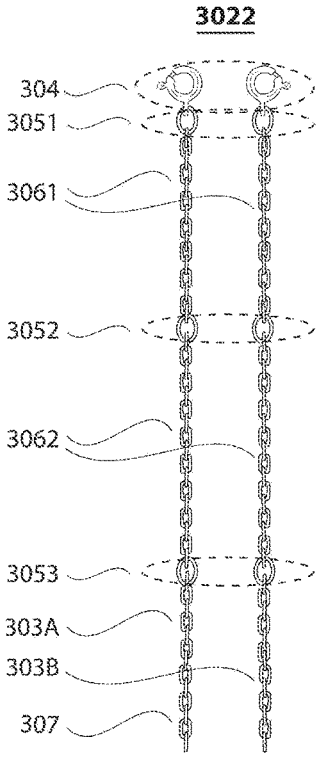
FIG. 3A is a front or top view of a strand of the layered jewelry piece depicting the spacing or distance between connector pairs and including connector pair sections of the strand disposed between such connector pairs.
Figure 3B:
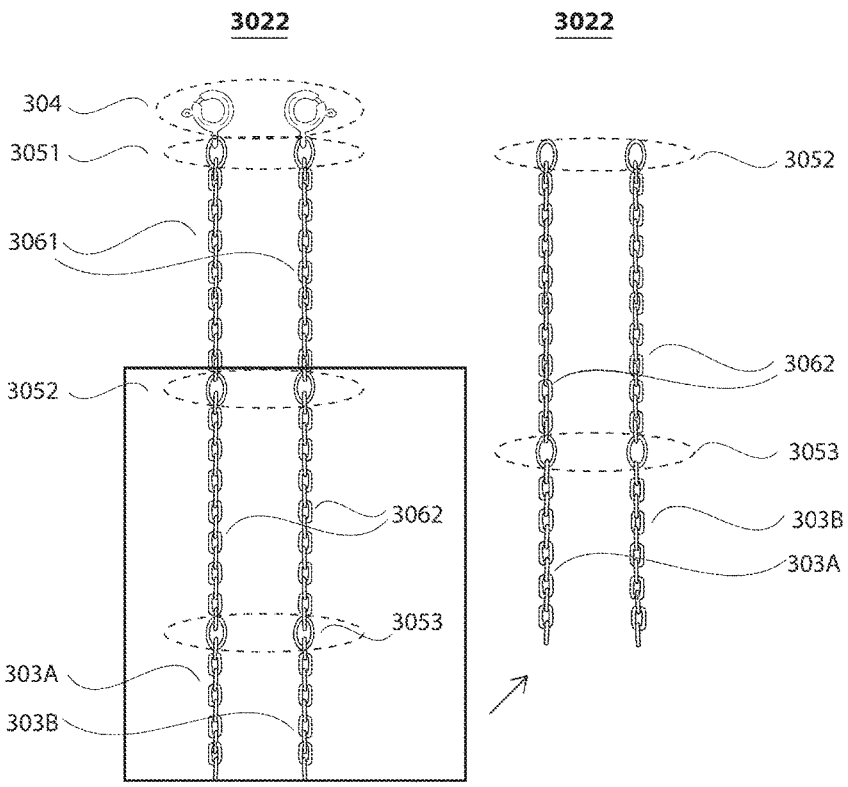
FIG. 3B is a partial, enlarged front or top view of the first connector pair sections of the strand in FIG. 3A compared to a partial, enlarged front or top view of the second connector pair sections of the strand in FIG. 3A.

Referring now to FIGS. 3A and 3B, more detailed information is provided about the inter-pair spacing of a preferred embodiment of the jewelry system of the present invention. In FIG. 3A, a partial view of a strand 3022 is shown. Strand 3022 corresponds to strand 1022 or 1023 of FIG. 1B since they are identical.

Partial strand 3022 has an optional end connector pair 3051 and the connectors of this connector pair form the ends of side A 303A of strand 3022 and side B 303B of strand 3022. Each end coupler of the end coupler pair 304 is connected to a connector of end connector pair 3051. Additionally, an end of both connector pair sections 3061 is also connected to a connector of connector pair 3051.

Connector pair sections 3061 are similar or equivalent in length. The other end of both connector pair sections 3061 is connected to a connector of connector pair 3052. An end of both connector pair sections 3062 is also connected to a connector of connector pair 3052. The other ends of connector pair section 3062 are connected to a connector in connecter pair 3053. Connector pair sections 3062 are similar (i.e. the same or approximately the same) in length. The ends of display section 307, which is partially depicted, are also connected to the connectors of connector pair 3053.

As described above, the length of any pair of connector pair sections (e.g. 3061 or 3062) is the inter-pair spacing and the inter-pair spacing is determined by the connector-to-end spacing. Consequently, the inter-pair spacing for connector pair section 3061 (namely, the spacing or length between end connector pair 3051 and connector pair 3052) is similar or equivalent to the connector-to-end spacing for connector pair 3052. Similarly, the inter-pair spacing for connector pair section 3062 (namely, the spacing or length between end connector pair 3052 and connector pair 3053) is equal to the difference between the connector-to-end spacing for connector pair 3053 and the connector-to-end spacing for connector pair 3052

As depicted in FIG. 3A, the end couplers of end coupler pair 304 are spring ring clasps, the connectors of the connector pairs 3051, 3052 and 3053 are oval jump rings or ring connectors, and connector pair sections 3061 and 3062 are lengths of chain.

Referring now to FIG. 3B, two partial and enlarged views of strand 3022 are depicted such that the length (or inter-pair spacing) of connector pair sections 3061 can be compared with the length (or inter-pair spacing) of connector pair sections 3062 by aligning connector pair 3051 with connector pair 3052. As depicted in FIG. 3B, connector pair sections 3061 are slightly shorter than connector pair sections 3062 (before magnification). In an embodiment of the present invention, connector pair sections 3062 and, if the strand had any additional connector pairs, the additional connector pair sections would be similar or equivalent in length to provide for optimal presentation of a layered jewelry piece such as 101 in FIG. 1A.

Figure 4:
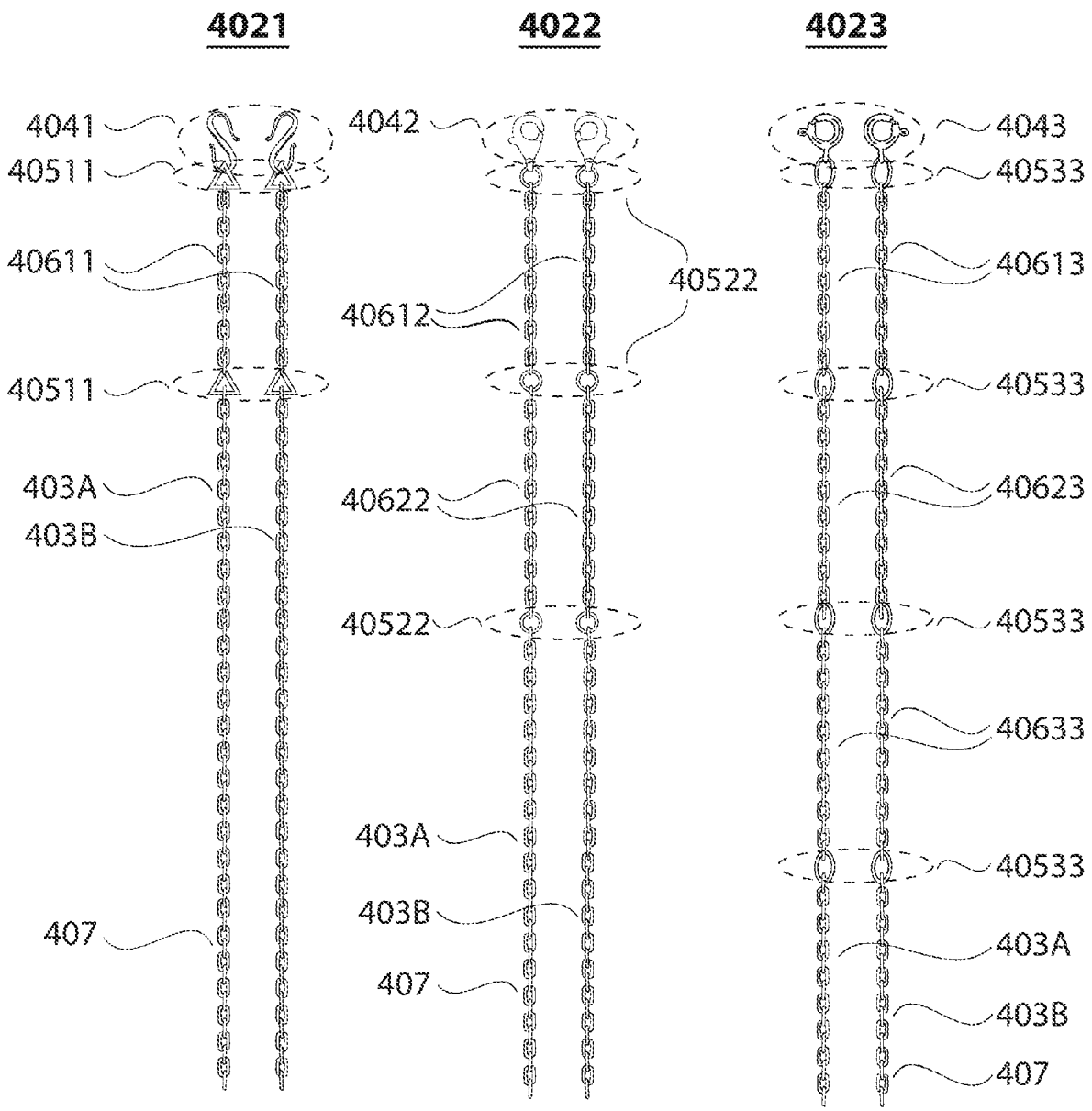
FIG. 4 is a front or top partial view of several types of strands which can be used in the jewelry system of the present invention and, in particular, depicting some examples of different types of end jewelry couplers and different numbers of connector pairs that can be used in the jewelry system of the present invention.

In FIG. 4, several types of partial strands with jewelry couplers are depicted which can be used in the jewelry system of the present invention. Strand 4021 has an A side 403A and a B side 403B; a pair of end couplers 4041 using S hook clasps; two connector pairs 40511, including an optional pair at the strand ends, using triangular jump rings or ring connectors; one pair of connector pair sections 40611; and a partial display section 407.

Strand 4022 has an A side 403A and a B side 403B; a pair of end couplers 4042 using lobster clasps; three connector pairs 40522, including an optional pair at the strand ends, using round jump rings or ring connectors; two pairs of connector pair sections 40612 and 40622; and a partial display section 407. Connector pair sections 40612 are slightly shorter than connector pair sections 40622.

Strand 4023 has an A side 403A and a B side 403B; a pair of end couplers 4043 using spring-ring clasps; four connector pairs 40533, including an optional pair at the strand ends, using oval jump rings or ring connectors; three pairs of connector pair sections 40613, 40623 and 40633; and a partial display section 407. Connector pair sections 40623 and 40633 are similar or equivalent in length. Connector pair sections 40613 are slightly shorter than connector pair sections 40623 and 40633.

All of the strands 4021, 4022 and 4023 depicted in FIG. 4 could be used as base strand or base layer or as an additional or supplemental strand or layer in the jewelry system of the present invention. As mentioned above, other strands having no connector pairs, could be used as an additional or supplemental strands or layers in the jewelry system of the present invention.

Figure 5:
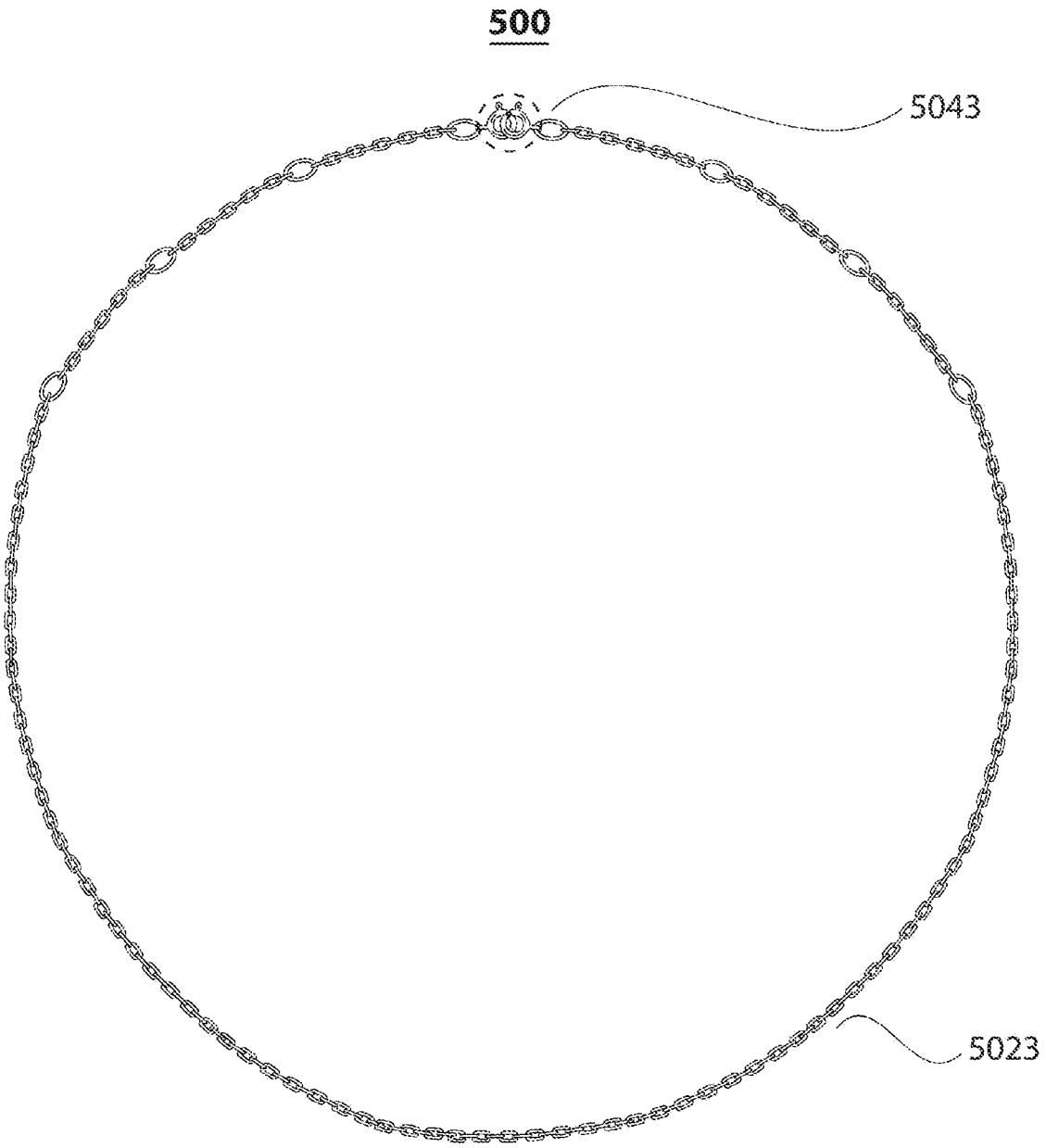
FIG. 5 is a front or top view of one of the strands, partially depicted in FIG. 4, with the end couplers connected forming a layer for display and which can be used as a base layer for a multi-strand or layered jewelry piece.

Referring now to FIG. 5, strand 5023 (depicted as strand 4023 in FIG. 4) is depicted and is arranged as a base layer for the jewelry system 500 of the present invention. Specifically, the end couplers of end coupler pair 5043 connected to strand 5023 have been removably connected together transforming strand 5023 into a base layer 5023 for the jewelry system 500.

Figure 6A:
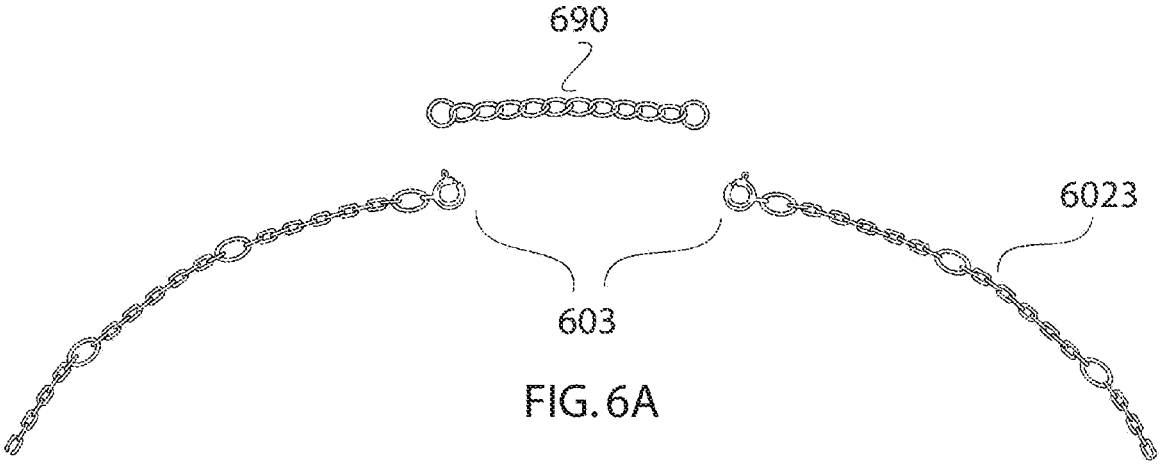
FIGS. 6A, 6B, and 6C are a series of views of a partial strand and a detachable length adjuster and demonstrating the use of the length adjuster to adjust the length of the strand for use a base layer of the jewelry system of the present invention.
Figure 6B:
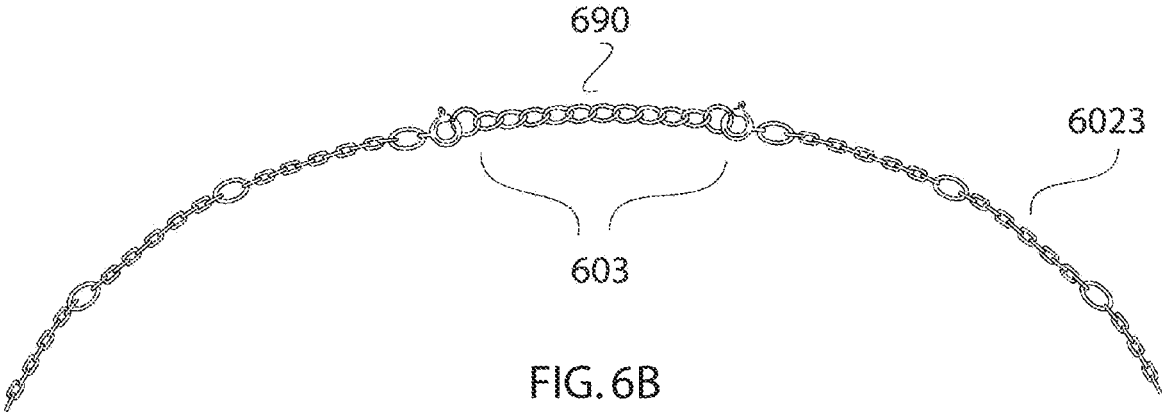
Figure 6C:
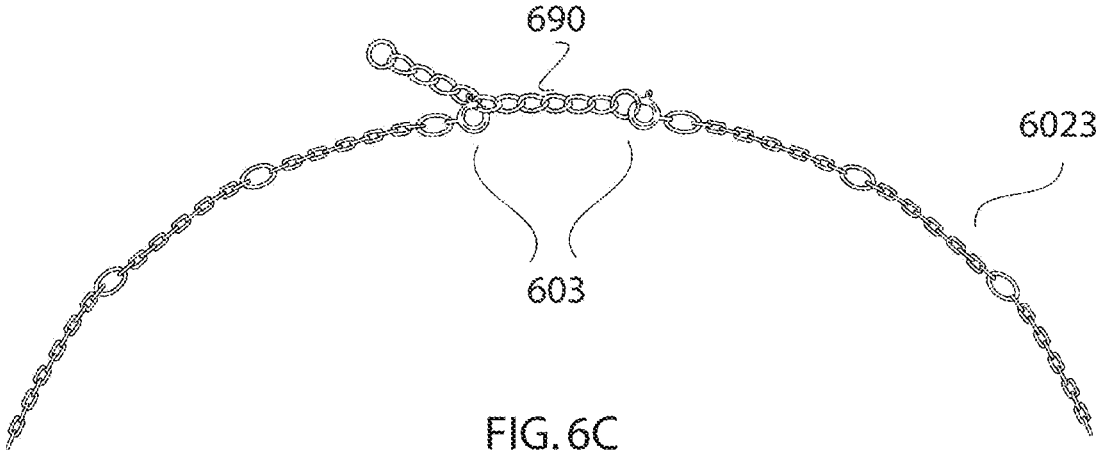

FIGS. 6A, 6B, and 6C are a series of views of a partial strand 6023 and a detachable length adjuster 690 and which demonstrate the use of the length adjuster 690 to adjust the length of the strand 6023 for use as a base layer in the jewelry system 600 of the present invention in FIG. 6B. In each of these FIGS. 6A, 6B and 6C, a portion of strand 6023 is visible with a pair of end couplers 603, such as spring ring clasps, is depicted. Strand 6023 is similar to strand 1023 in FIG. 1B. The length adjuster 690 in each of FIGS. 6A, 6B and 6C is comprised of one or more interconnected jewelry couplings. Although any form of jewelry couplers can be used in the length adjuster 690, a simple an effective embodiment of the length adjuster is depicted in these Figures and consists of a small portion of a jewelry chain with interconnected couplings, such as ring connectors, throughout. It will be understood that the openings in the chain links of adjuster 690 must be sufficiently wide to removably connect with the end couplers 603 (e.g. spring ring clasps).

In FIG. 6A, the adjuster 690 is depicted completely detached from the end couplers 603. In FIG. 6B, the end couplers 603 of strand 6023 are removably connected to end couplings of the adjuster 690 which offers the greatest length extension to strand 6023; now base layer 6023. In FIG. 6C, the end couplers 603 of base layer 6023 are removably connected to an end coupling of the adjuster 690 and another coupling in the interior of length adjuster 690. This connection results in an intermediate length extension to base layer strand 6023; now base layer 6023.

Figure 6D:
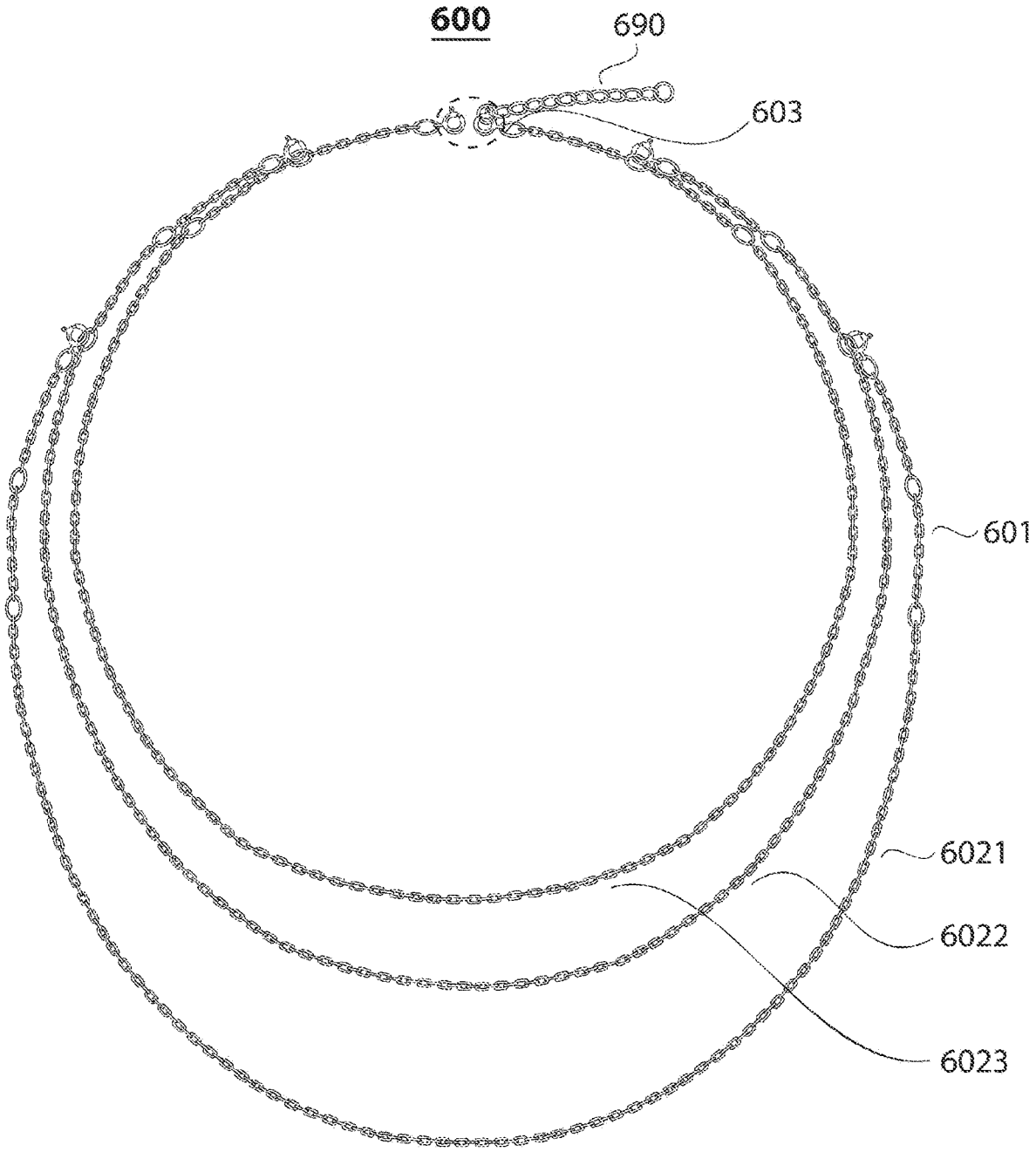
FIG. 6D is a front or top view of layered jewel piece of FIG. 1 employing the present invention and including the length adjuster, and ready for display or wearing.

Referring now to FIG. 6D, a front or top view of the layered jewel piece 601 (similar to the layered jewelry piece 101 of FIG. 1) employing the jewelry system 600 of the present invention, including a length adjuster 690, is depicted. The layered piece includes a base layer 6023 to which a second layer 6022 is removably connected to a connector pair on the base layer 6023 and a third layer 6021 which is removably connected to a connector pair on the second layer 6022. One of the end couplers 603 of the base layer 6023 is removably connected to a coupling on one end of the length adjuster 690. The layered piece 601 is ready for display or wearing by removably connecting the other end coupler 603 of base layer 6023 to the other end coupler 603 on the base layer 6023 or extending the length of the base layer 6023 by removably connecting such other end coupler to another coupling on the length adjuster 690.

It will be understood and appreciated that many forms and methods for extending or lengthening jewelry are available and can work with the jewelry system 600 of the present invention for lengthening the base layer.

Figure 7:
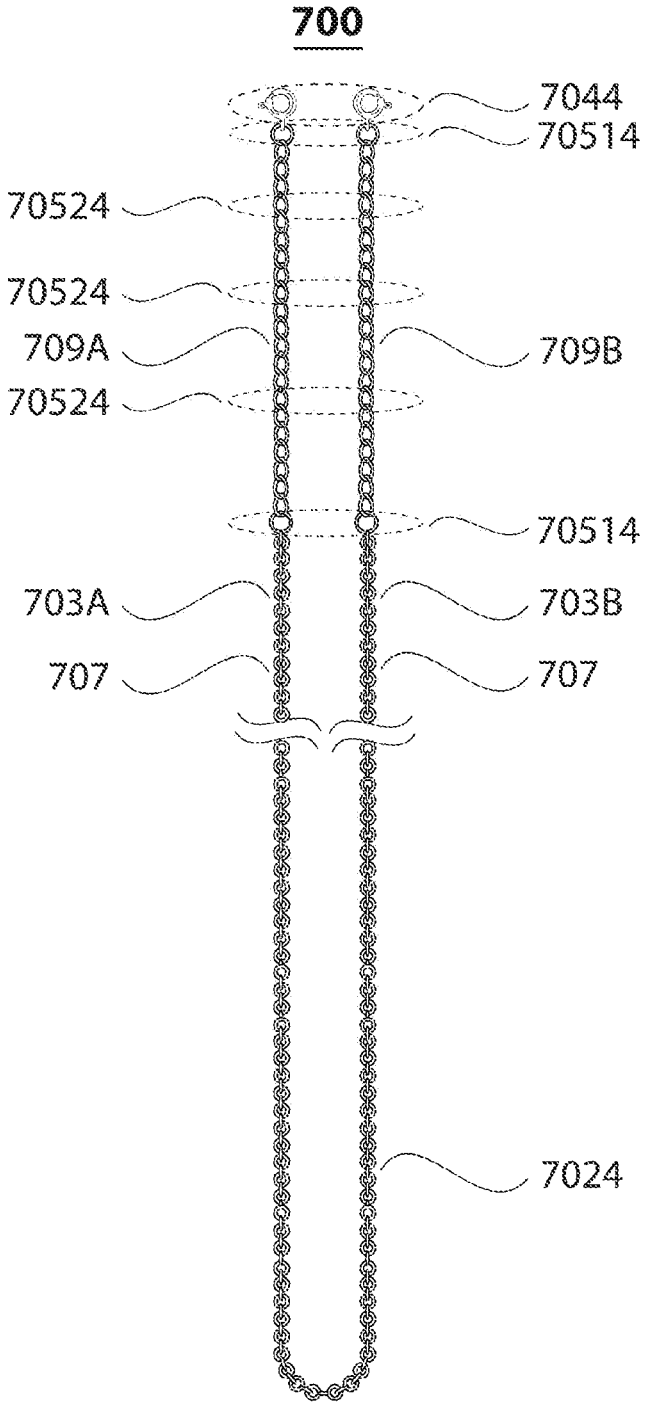
FIG. 7 is a view of a strand depicting another embodiment of the invention.

It will be understood and appreciated that the present invention may be implemented in other embodiments. One such example of another embodiment is depicted in FIG. 7. In FIG. 7, a front or top view of a different embodiment of the jewelry system 700 of the present invention is depicted and includes an enlarged, partial view of a single strand

7024. The strand 7024 comprises a side A 703A; a side B 703B; an end coupler pair 7044, a display section 707 partially depicted, and two sections of strand 709A and 709B which interconnect the display section 707 with the end coupler pair 7044. Each strand section 709A and 709B are comprised of a plurality of interconnected jewelry couplings wherein the couplings in or on strand section 709A form a plurality of connector pairs 70514 and 70524 with respective couplings in or on strand section 709B.

In FIG. 7, the similar, connector-to-end spacing, for each connector in each connector pair, of the present invention is maintained. For example, the distance from the connector in or on strand section 709A of the first connector pair 70524 to the end connector 70514 in or on strand section 709A is similar to the distance from the connector in or on strand section 709B of the first connector pair 70524 to the end connector 70514 in or on strand section 709B. The inter-pair spacing is not relevant since each the connectors of each successive connector pair are connected to each other.

In the jewelry system 700 of the present invention, strand 7024 may be used as the base layer in a layered jewelry piece. The other strands/layers may be: similar to strand 7024; similar to the strands depicted in FIG. 1B; may have no connector pairs at all; or any combination thereof. In this jewelry system 700, using strand 7024 as the base layer, the user determines the spacing between the base layer and the second layer and may determine the spacing between one or more subsequent layer. For example, if the user were to connect all of the additional layers to different connector pairs (e.g. 70524) on the base strand or layer (i.e. 7024), then the user would determine the spacing between all layers in the layered piece by which connector pairs (e.g. 70524) the user chooses to use for the removable connection with end couplers of the additional layers.

It will be further appreciated and understood that, although the present invention has been described above primarily with respect to necklaces and multi-strand necklaces, it is applicable to other layered jewelry applications such as, for example, bracelets, anklets, body chains and belly chains.

It is, therefore, intended by the appended claims to cover any and all such applications, modifications, and embodiments within the scope of the present invention.

What is claimed is:

1. A base necklace strand for a layering necklace system, wherein the layering necklace system comprises two or more necklace strands including the base necklace strand and one or more additional necklace strands of equivalent or greater length than the base necklace strand, and wherein each such necklace strand can be worn as an individual necklace and wherein, when the base necklace strand and one or more necklace strands of the one or more additional necklace strands are layered together with the layering system and worn by a user, a layered necklace is formed in which all of the necklace strands are separated and distinctly presented, the base necklace strand comprising:

a side A with an end coupler A at the end thereof and a side B with a end coupler B at the end thereof;

two or more pairs of strand connectors, each such strand connector pair having an A strand connector connected to side A of the base necklace strand and a corresponding B strand connector connected to side B of the base necklace strand;

wherein the distance from the end of side A to the A strand connector in each strand connector pair is equivalent to the distance from the end of side B to the corresponding B strand connector in each such strand connector pair;

wherein the A strand connectors and the B strand connectors of the strand connector pairs are spaced apart from the end of side A and side B, respectively, of the base necklace strand;

a display section connected between side A and side B of the base necklace strand, the display section having an end connected to the A side of the base necklace strand, another end connected to the B side of the base necklace strand, and having no strand connectors coupled thereto which are spaced apart from the ends of the display section; and wherein end couplers A and B of the base necklace strand can be removably connected together to form a necklace or a base necklace-layer for the layering necklace system and to which one or more of the one or more additional necklace strands can be removably connected to one of the two or more strand connector pairs of the base necklace strand to form the layered necklace.

2. A layering necklace system having the base necklace strand of claim 1 and further comprising:

one or more additional necklace strands including a first additional necklace strand, each such additional necklace strand having a side A with an end coupler A at the end thereof and a side B with an end coupler B at the end thereof; and wherein end couplers A and B of the first additional necklace strand can be removably connected to the A and B strand connectors, respectively, of a strand connector pair on the base necklace strand to form a layered necklace.

3. The layering necklace system of claim 2 wherein any two or more of the necklace strands are equivalent in length.

4. The layering necklace system of claim 2 wherein one or more of the one or more additional necklace strands and including the first additional necklace strand, comprising:

one or more additional strand connector pairs coupled to such additional necklace strands, each such additional strand connector pair having an additional A strand connector coupled to side A of the additional necklace strand and an additional B strand connector coupled to side B of the additional necklace strand; and wherein the A and B strand connectors of each such additional strand connector pair are spaced an equivalent distance from the ends of side A and side B, respectively, of such additional necklace strand.

5. The layering necklace system of claim 4 wherein any additional necklace strand having one or more strand connector pairs coupled thereto, can be used as the base necklace-layer for a layered necklace.

6. The layering necklace system of claim 4 wherein, for any necklace strand, including the base necklace strand and the one or more additional necklace strands having two or more strand connector pairs coupled thereto, the spacing between all of the A strand connectors on side A of such a necklace strand having two or more strand connector pairs and all of the B strand connectors on side B of such a necklace strand having two or more strand connector pairs are equivalent.

7. The layering necklace system of claim 2 all of the additional necklace strands are equivalent in length.

8. The layering necklace system of claim 2 wherein the separation of the necklace-layers prevents tangling of the necklace-layers of the layered necklace while it is being worn.

9. The base necklace strand of claim 1 having a plurality of base necklace strand connector pairs wherein the spacing between all of the A strand connectors on side A of the base necklace strand and all of the B strand connectors on side B of the base necklace strand is equivalent.

10. The base necklace strand for a layering necklace system of claim 1 further comprising:

a length adjuster having two or more couplings and to which the end couplers A and B of the base necklace strand can be removably connected to different couplings of such two or more length adjuster couplings, to adjust the length of the base necklace-layer.

11. The base necklace strand for a layering necklace system of claim 1 wherein:

end coupler A at the end of side A of the base necklace strand can be removably connected to side B of the base necklace strand for forming a base connection joint thereat and an alternate base necklace-layer for the layering necklace system; for adjusting the length of such alternate base necklace-layer, and for forming at least one or more alternate base connector pairs on such alternate base necklace-layer wherein each such alternate base connector pair is comprised of an A strand connector on the A side of the base necklace strand and a corresponding B strand connector on the B side of the base necklace strand disposed an equivalent distance from the base connection joint as the A strand connector of such alternate base connector pair.

12. A layering necklace system, wherein each necklace strand can be worn as an individual necklace, wherein the plurality of necklace strands includes a base necklace strand and a second necklace strand, wherein the base necklace strand is shorter than or equivalent in length to the other necklace strands in the plurality of necklace strands, and wherein, when the base necklace strand and one or more of the other necklace strands in the plurality of necklace strands are layered together with the layering necklace system and worn by a user, a layered necklace is formed in which all of the strands are separated and distinctly presented, the layering necklace system comprising:

an end coupler A connected at the end of a side A on each necklace strand in the plurality of necklace strands, including the base necklace strand and the second necklace strand;

an end coupler B connected at the end of a side B on each necklace strand in the plurality of necklace strands, including the base necklace strand and the second necklace strand;

one or more strand connector pairs coupled to the base necklace strand, each such strand connector pair having an A strand connector coupled to side A of the base necklace strand and a corresponding B strand connector coupled to side B of the base necklace strand and spaced an equivalent distance from the end of side B of the base necklace strand as the distance from the end of side A of the base necklace strand to the A strand connector of such strand connector pair;

wherein the A strand connectors and the B strand connectors of the strand connector pairs are spaced apart from the end of sides A and side B, respectively, of the base strand;

wherein the end couplers A and B of the second necklace strand can be removably connected to the A strand connector of a first strand connector pair of the one or more strand connector pairs coupled to the base necklace strand and to the corresponding B strand connector of such first strand connector pair, respectively, to form a second necklace-layer; and wherein the end couplers A and B of the base necklace strand can be removably connected together to form a layered necklace having a base necklace-layer and a second necklace-layer.

13. The layering necklace system of claim 12 wherein the base necklace strand has a plurality of strand connector pairs, the layering necklace system further comprising:

a third necklace strand from the plurality of necklace strands for forming a third necklace-layer of the layered necklace, such third necklace-layer having end couplers A and B;

wherein the end coupler A of such third necklace strand can be removably connected to the A strand connector of a second strand connector pair on the base necklace-layer; and wherein the end coupler B of such third necklace strand can be removably connected to the B strand connector of such second strand connector pair on the base necklace-layer to form a third layer of the layered necklace.

14. The layering necklace system of claim 12 further comprising:

a length adjuster having a plurality of couplings, and wherein the end couplers A and B of the base necklace strand can be removably connected to different couplings of the plurality of length adjuster couplings, to adjust the length of the base necklace-layer.

15. The layering necklace system of claim 12, having a third necklace strand from the plurality of necklace strands, such third necklace strand having A and B end couplers, the layering necklace system further comprising:

one or more second strand connector pairs coupled to the second necklace strand, each such second strand connector pair having an A strand connector coupled to side A of the second necklace strand and a corresponding B strand connector coupled to side B of the second necklace strand and spaced an equivalent distance from the end of side B of the necklace strand as the distance from the end of side A of the second necklace strand to the A strand connector of such second strand connector pair;

wherein the end coupler A of such third necklace strand can be removably connected to the A strand connector of a strand connector pair coupled to the second necklace-layer or to the A strand connector of an additional strand connector pair of the one or more strand connector pairs coupled to the base necklace-layer when there are a plurality of strand connector pairs coupled to the base strand; and wherein the end coupler B of such third strand can be removably connected to the B strand connector of such strand connector pair coupled to the second necklace-layer or to the B strand connector of an additional strand connector pair of the one or more strand connector pairs coupled to the base necklace-layer when there are a plurality of strand connector pairs coupled to the base necklace-layer, to form a third necklace-layer of the layered necklace.

16. The layering necklace system of claim 12 wherein every strand, including the base necklace strand and the second necklace strand, has one strand connector pair.

17. In a layering necklace system having a plurality of necklace strands, wherein each necklace strand can be worn as an individual necklace, wherein each such necklace strand has a side A with an end coupler A at the end thereof and a side B with an end coupler B at the end thereof, wherein at least one of such necklace strands has one or more strand connector pairs, each such strand connector pair having an A strand connector coupled to side A of the necklace strand and a B strand connector coupled to side B of the such necklace strand, wherein the distance from the A strand connector and the B strand connector of each such connector pair from the ends of the sides A and side B, respectively, is equivalent, wherein the A strand connectors and the B strand connectors of the strand connector pairs are spaced apart from the end of sides A and side B, respectively, of the necklace strand; and wherein, when two or more of the necklace strands in the plurality of necklace strands are layered together with the layering necklace system and worn by a user, a layered necklace is formed in which all of the necklace-layers are separated and distinctly presented, the method of building a layered necklace comprising the steps of:

selecting a first necklace strand from the plurality of necklace strands as the base necklace-layer for the layered necklace, such first necklace strand having one or more strand connector pairs and wherein such base necklace strand is shorter than or of equivalent length to the other necklace strands in the plurality of necklace strands;

selecting a second necklace strand from the plurality of strands as a second necklace strand for the layered necklace;

removably connecting end coupler A of the second necklace strand to the A strand connector of a first strand connector pair on the base necklace strand;

removably connecting end coupler B of the second necklace strand to the B strand connector of such first strand connector pair on the base necklace strand to form a second necklace-layer for the layered necklace: and removably connecting end coupler A of the base necklace strand to end coupler B of the base necklace strand thereby forming a base necklace-layer and a layered necklace having two necklace-layers.

18. The method of claim 17 wherein the second necklace strand selected from the plurality of necklace strands for the second necklace-layer of the layered necklace also has one or more additional strand connector pairs; the method further comprising the steps of:

selecting a third necklace strand from the plurality of necklace strands for a third necklace-layer of the layered jewelry piece;

removably connecting end coupler A of the third necklace strand to the A strand connector of a strand connector pair on the second necklace-layer or to the A strand connector of an additional strand connector pair of the one or more connector pairs on the base necklace-layer when the base necklace-layer has a plurality of strand connector pairs; and removably connecting end coupler B of the third necklace strand to the B strand connector of such second strand connector pair on the second necklace-layer or to the B strand connector of such additional strand connector pair of the one or more connector pairs on the base necklace-layer when the necklace-layer has a plurality of strand connector pairs, thereby forming a third necklace-layer and a layered necklace having three necklace-layers.

19. The method of claim 17 wherein the layering necklace system further includes a length adjuster having two or more couplings, the method further comprising the step of:

removably connecting end couplers A and B of the base necklace strand to different couplings of such two or more length adjuster couplings for adjusting the length of the base necklace-layer.

20. The method of claim 17 wherein the base necklace strand has a plurality of strand connector pairs, the method further comprising the steps of:

selecting a third necklace strand, with end couplers A and B, from the plurality of necklace strands for a third necklace-layer strand of the layered necklace;

removably connecting end coupler A of the third necklace strand to the A strand connector of an additional strand connector pair of the one or more connector pairs on the base necklace-layer; and removably connecting end coupler B of the third necklace strand to the B strand connector of such additional strand connector pair of the one or more connector pairs on the base necklace-layer, thereby forming a third necklace-layer of the layered necklace.

* * * * *